US010160616B2

(12) United States Patent
Clayson et al.

(10) Patent No.: US 10,160,616 B2
(45) Date of Patent: Dec. 25, 2018

(54) ADHESIVE TAPE DISPENSER AND AN ADHESIVE TAPE ROLL

(71) Applicant: Borgmeister & Soehne Ltd., Liverpool (GB)

(72) Inventors: Gerard Clayson, Liverpool (GB); Daniel Brusius, Siegen (DE)

(73) Assignee: BORGMEISTER & SOEHNE LTD., Liverpool (GB)

( * ) Notice: Subject to any disclaimer, the term of this patent is extended or adjusted under 35 U.S.C. 154(b) by 198 days.

(21) Appl. No.: 14/719,643

(22) Filed: May 22, 2015

(65) Prior Publication Data

US 2015/0336761 A1 Nov. 26, 2015

(30) Foreign Application Priority Data

May 23, 2014 (DE) ..... 10 2014 209 834

(51) Int. Cl.
*B32B 27/00* (2006.01)
*B65H 35/00* (2006.01)
(Continued)

(52) U.S. Cl.
CPC ..... *B65H 35/0033* (2013.01); *B65H 18/28* (2013.01); *B65H 2301/41358* (2013.01);
(Continued)

(58) Field of Classification Search
CPC ..... B65H 2601/326; B65H 35/002; B65H 35/0013; B65H 35/0026; B65H 35/0033;
(Continued)

(56) References Cited

U.S. PATENT DOCUMENTS 2,582,980 A * 1/1952 Fritzinger ..... B65H 35/0033 156/523
3,709,760 A 1/1973 Knoner
(Continued)

FOREIGN PATENT DOCUMENTS

DE 20004301 U1 6/2000
GB 1020751 A * 2/1966 ..... B65H 35/0026
GB 2397258 A 7/2004

OTHER PUBLICATIONS

European Search Report issued in connection with European application No. EP 15169000; dated Feb. 29, 2016.
(Continued)

*Primary Examiner* — Alex B Efta
(74) *Attorney, Agent, or Firm* — The Marbury Law Group, PLLC

(57) ABSTRACT

The present disclosure relates to an adhesive tape dispenser, for an adhesive tape roll having a core element, said dispenser essentially consisting of or comprising a carrier unit, in particular a housing, at least one grip member being connected, in particular via a connecting member, to the carrier unit for handling of the adhesive tape dispenser, a first bearing member essentially consisting of or comprising a rotatable bearing shaft arranged and adjusted for receiving the core element of an adhesive tape roll and for rotatably supporting said roll which is directly or indirectly arranged on and/or fastened to the carrier unit, a second bearing member essentially consisting of or comprising an, in particular non-rotatable, bearing shaft, which is directly or indirectly arranged on and/or fastened to the carrier unit, and a receiving member arranged and adjusted for receiving the core element of an adhesive tape roll that is rotatably arrangeable or supported on said second bearing shaft, an, in particular rotatable, applicator unit for attaching the adhesive tape to objects which is directly or indirectly joined to
(Continued)

the carrier unit or which is integral with said carrier unit, at least one fastening means for a cutting blade, which is directly or indirectly joined to the carrier unit or which is integral with said carrier unit, and optionally a cutting blade held by said fastening means, wherein the grip member and applicator unit are located on opposite sides of the first or second bearing member and/or of the center of gravity of the dispenser. Furthermore the disclosure relates to an adhesive tape roll consisting of or comprising a core which comprises a receiving opening extending through the core in the longitudinal direction and an adhesive tape which is wound onto the core, wherein the core consists of or comprises a plastic material or a metal material, that the receiving opening which extends through the core has a polygonal cross-section, and that at least one stop is provided at an end of the receiving opening.

21 Claims, 12 Drawing Sheets

(51) Int. Cl.
*B65H 18/28* (2006.01)
*B44C 7/00* (2006.01)

(52) U.S. Cl.
CPC .... *B65H 2402/412* (2013.01); *B65H 2402/61* (2013.01); *B65H 2701/535* (2013.01); *Y10T 156/1365* (2015.01); *Y10T 156/1793* (2015.01)

(58) Field of Classification Search
CPC ..... B65H 35/005; B65H 35/008; B65H 2701/32; H02G 1/00; B29C 63/02; B29C 63/024
See application file for complete search history.

(56) References Cited

U.S. PATENT DOCUMENTS

| | | | | |
|---|---|---|---|---|
| 3,871,940 | A * | 3/1975 | Antonioni | B05C 9/10 156/353 |
| 4,919,358 | A | 4/1990 | Innocenti, Sr. et al. | |
| 5,269,871 | A * | 12/1993 | Longworth | B65H 35/0033 156/527 |
| 5,725,726 | A * | 3/1998 | Yu | B65H 35/0033 156/577 |
| 6,077,577 | A | 6/2000 | Spatorico et al. | |
| 6,688,549 | B1 * | 2/2004 | Shen | B65H 35/0026 242/588 |
| 7,669,631 | B2 * | 3/2010 | Bailey | B65H 35/0033 156/523 |
| 2003/0094243 | A1 * | 5/2003 | Charriere | B65H 35/0033 156/577 |

OTHER PUBLICATIONS

Written Opinion issued in connection with European application No. EP 15169000; dated Feb. 29, 2016.

* cited by examiner

ADHESIVE TAPE DISPENSER AND AN ADHESIVE TAPE ROLL

The present disclosure relates to an adhesive tape dispenser and to an adhesive tape roll.

Adhesive tape dispensers are in use for a long time. It can be differentiated between adhesive tape dispensers to be used as stationary or for household purposes and adhesive tape dispensers used for packaging of large articles. In the latter case conventional adhesive tape dispensers are usually equipped with a handle or a grip. An example of such adhesive tape dispenser can be found in DE 20 2010 017 005 U1. Here, the handle or grip member is radially aligned with respect to the core element of the adhesive tape roll.

Even for commercial packaging purposes adhesive tape dispensers are regularly operated manually. Packaging by use of conventional adhesive tape dispensers can be rather laborious and tedious and due to tiring may result in incomplete or insufficient packaging causing the risk that the packaged product will be prematurely unfastened.

It would thus be desirable to be able to make use of improved adhesive tape dispensers. Accordingly, it has been an object of the present disclosure to make available adhesive tape dispensers which have improved ergonomic properties and which allow for a more reliable packaging even after longer periods of continuous use.

The problem underlying the present disclosure has been solved by an adhesive tape dispenser, for an adhesive tape roll having a core element, said dispenser essentially consisting of or comprising

- a carrier unit, in particular a housing,
- at least one grip member being connected, in particular via a connecting member, to the carrier unit for handling of the adhesive tape dispenser,
- a first bearing member essentially consisting of or comprising a rotatable bearing shaft arranged and adjusted for receiving the core element of an adhesive tape roll and for rotatably supporting said roll which is directly or indirectly arranged on and/or fastened to the carrier unit,
- a second bearing member essentially consisting of or comprising an, in particular non-rotatable, bearing shaft, which is directly or indirectly arranged on and/or fastened to the carrier unit, and a receiving member arranged and adjusted for receiving the core element of an adhesive tape roll that is rotatably arrangeable or supported on said second bearing shaft,
- an, in particular rotatable, applicator unit for attaching the adhesive tape to objects which is directly or indirectly joined to the carrier unit or which is integral with said carrier unit,
- at least one fastening means for a cutting blade, which is directly or indirectly joined to the carrier unit or which is integral with said carrier unit, and optionally a cutting blade held by said fastening means, e.g. by a holder, wherein

- the grip member and applicator unit are located on opposite sides of the first or second bearing member and/or of the center of gravity of the dispenser.

Accordingly, it has been found to be advantageous to arrange the first bearing member, in particular the first bearing shaft, or the second bearing shaft, in particular the receiving member, and/or the center of gravity of the dispenser between the grip member and the applicator unit, in particular, with regard to a hypothetic axis or plane to be formed between the grip member, in particular that portion to be regularly held by the hand during operation, and the applicator unit and running through the first or second bearing member and/or through the center of gravity of the dispensing unit. In an advantageous embodiment said hypothetical axis or plane is in particular essentially in parallel to the longitudinal orientation, i.e. longitudinal axis of the grip member, in particular that portion of the grip member which is held by the hand during regular operation of the adhesive tape dispenser, and in particular also orthogonal with regard to the shortest distance between the longitudinal axis of the grip member and the first or second bearing member and/or of the center of gravity of the dispenser. In one preferred embodiment said shortest distance is meant to be the shortest distance between the longitudinal axis of the grip member and the first or second bearing member and/or of the center of gravity of the dispenser when this line determining the shortest distance is orthogonal to both said hypothetical plane or axis and the longitudinal axis of the grip member, in particular that portion being held by the hand during operation.

Accordingly, it is preferred that the applicator unit is essentially opposite the grip member, in particular opposite that portion of the grip member which is held by the hand during regular operation of the adhesive tape dispenser, with regard to the above-described hypothetical axis, in particular plane. In one embodiment it is sufficient that the applicator unit is lying on that side of the above-mentioned hypothetical axis or plane which is opposite the grip member, in particular that portion being held by the hand during operation. By having the grip member and the applicator unit arranged on opposite sides with regard to the first or second bearing member and/or of the center of gravity of the dispenser or with regard to the hypothetical axis or plane as described above, it is possible to align the longitudinal axis of the grip member, in particular that portion being held by the hand during operation, essentially in parallel to the plane that portion of the adhesive tape is lying in which is released from the applicator unit when being applied to a surface. Or in other words, the dispenser of the present disclosure allows to align the longitudinal axis of the grip member, in particular that portion being held by the hand during operation, essentially in parallel to the surface of the object to which the adhesive tape shall be applied. This allows for a very ergonomic handling.

With the applicator unit the adhesive tape is regularly applied to an object. The applicator unit may also be called a dispenser unit.

The fastening means for the cutting blade can comprise, for example, screws or pins which are placed through respective holes in the cutting blade, or can comprise a clamp or a holder which fixes the cutting blade, preferably in a releasable manner so that it can be easily replaced.

The applicator unit advantageously comprises a rotatably mounted roll. Such roll is particularly suited for safely and reliably attaching the adhesive tape to objects.

According to a preferred embodiment the longitudinal axis of the grip member which has a longitudinal orientation is aligned essentially in parallel and spaced apart from a tangent which is alignable to the outer circular contour of an adhesive tape roll supportable or supported on said receiving member or on said first bearing shaft and/or to the bearing shaft of the first or second bearing member. Moreover, said longitudinal axis, including any extension of said axis beyond the opposite ends of the grip member, is preferably spaced apart from the outer contour of an adhesive tape roll supportable or supported on said receiving member or on said first bearing shaft. Such construction usually allows to arrive at a highly ergonomic adhesive tape dispenser.

Moreover, it has been surprisingly found out that when the longitudinal axis of the grip member having a longitudinal orientation is aligned essentially in parallel to the plate-shaped or rod-shaped release device for the cutting blade the severing process can be conducted in a very reliable manner and that essentially any premature cutting can be prevented.

According to another embodiment of the adhesive tape dispenser of the present disclosure the longitudinal orientation of the grip member is aligned essentially in parallel to a tangent which is alignable to the outer contour of an adhesive tape roll supportable or supported on said receiving member or on said first bearing shaft.

According to a preferred embodiment of the present disclosure the adhesive tape dispenser further comprises an, in particular plate-shaped, arc-shaped or angled, spacer having a spacer surface facing away from the first or second bearing member and having a first segment which is turned towards the dispensing unit, in particular the rotatably mounted roll, and a second segment which is facing away from said dispensing unit, in particular from the rotatably mounted roll. The spacer is mounted to the carrier unit or is integral with said carrier unit and is arranged adjacent to the rotatably mounted roll of the dispensing unit. And, the spacer is also arranged, with regard to the holder or fastening means of the cutting blade on the other side of said roll.

Said spacer can be fixedly attached to the carrier unit. Alternatively, said spacer can be movably fastened to said carrier unit, e.g. to the housing, in particular rotatably or pivotably attached. Said spacer on the one hand protects both the housing/carrier unit as well as the adhesive tape which is unwound from the adhesive tape roll and guided towards and over the dispensing unit to objects. Furthermore by arranging said spacer adjacent to the dispensing unit the operationally active region of the tape dispenser is limited to the most favored site of the carrier unit. In case the spacer is rotatably or pivotably mounted to the carrier unit, it can be moved towards the dispensing unit during operation and thereby push against an adhesive tape being guided on the rotatably mounted roll.

Accordingly, in one embodiment the spacer is pivotably or rotatably mounted about an axis on the carrier unit and is arranged and adjusted in such a manner that the first segment of the spacer which is turned towards the dispensing unit, in particular towards the rotatably mounted roll, is pressed against said roll or against the adhesive tape being guided on said roll when the adhesive tape dispenser is in operation.

It has been found to be beneficial that the first segment which is turned towards the dispensing unit, in particular towards the rotatably mounted roll, is angled with regard to the spacer surface. This allows the spacer to properly function as a spacer even when tilted towards the dispensing unit. The spacer surface in this embodiment can still be placed in parallel to the surface of the object.

With the adhesive tape dispenser according to the present disclosure it has been found to be advantageous to make use of a connecting member which aids in bridging the gap between the grip member, i.e. the grip or handle portion which is held by the user during regular operation of the adhesive tape dispenser, and the carrier unit, in particular housing. By use of the connecting member the gap between on the one hand the grip member and on the other hand the carrier unit or the housing or the adhesive tape roll fixed to the carrier unit or the housing can be adjusted so that the fingers can be safely and easily placed in this gap thereby allowing to firmly hold the grip member. The distance between the grip member and the carrier unit, housing or tape roll can for example be in the range from 2 cm to 6 cm or from 2.5 cm to 4.5 cm. In a preferred embodiment the connecting member comprises a first and an opposite second end and a longitudinal orientation between said first and second end. In this embodiment said first end is joined or combinable with the carrier unit and said second end is joined or combinable with the grip member. Here the longitudinal orientation of the connecting member and the longitudinal orientation of the grip member at its second end of said connecting member and facing towards the carrier unit are forming an obtuse angle, a right angle or a pointed angle, in particular an obtuse angle.

It is preferred that the longitudinal orientation of the connecting member is aligned essentially in parallel and optionally spaced apart from a tangent which is alignable to the outer contour of an adhesive tape roll supportable or supported on said receiving member or on said first bearing shaft.

It has been found to be of particular advantage when the connecting member is arranged and adapted in such a manner that the grip member is laterally spaced apart from the carrier unit, in particular from the housing, and/or spaced apart from an adhesive tape roll supportable or supported on said receiving member or on said first bearing shaft. In such a manner the handling of the adhesive tape dispenser can be greatly facilitated.

With the adhesive tape dispenser of the present disclosure also those embodiments are included in which at least component of the grip member and a component of the carrier unit, in particular the housing, are made in one piece. For example, the housing of such adhesive tape dispenser can be made of two halves, which in particular act as image and mirror-image, and which halves also include part of the grip member.

According to another preferred embodiment the adhesive tape dispenser further comprises a swivel arm, in particular comprising or made of metal, pivotably mounted about a rotational axis to the carrier unit comprising a first and an opposite second end comprising at or adjacent to said first end said first bearing member, in particular said first rotatably mounted bearing shaft, or said second bearing member, in particular said receiving member, and adjacent to said second end a pivotable connecting means, in particular comprising or made of metal, with the carrier unit, and further comprising an elastic element or a spring element, in particular a yoke spring, adapted and arranged in a manner that it exerts a spring load onto the swivel arm, in particular located at the connecting means. The swivel arm including the connecting means, and in particular also the second bearing member, are preferably made of metal, most preferable in one piece.

In a preferred embodiment at or adjacent to the first end of the swivel arm there is provided a first guiding means, which in particular is an extension of the swivel arm, and an, in particular arc-shaped, second guiding means, in particular a guiding groove or guiding rail, e.g. a stop landing location for the swivel arm. Said first guiding means engages with said second guiding means in order to safely and reliably guide any movement of the swivel arm. Accordingly, said swivel arm is pivotably mounted about a rotational axis comprising a first end and an opposite second end. At or adjacent to said first end said swivel arm comprises said first bearing member, in particular said first rotatably mounted bearing shaft, or said second bearing member, in particular said rotatably mounted receiving member for receiving the core element of an adhesive tape roll, and at or adjacent to said second end a rotatable connecting means with the carrier unit. By use of a swivel arm it can be taken care of the fact that the diameter of the adhesive tape roll changes significantly during use. This can advantageously be accomplished by such adhesive tape dispenser which further comprises an elastic element or a spring element, in particular a yoke spring, which exerts a spring load onto the swivel arm, in particular located at the connecting means.

In a very pragmatic embodiment it is provided that at or adjacent to the second end of the swivel arm there is, with regard to said first end of said swivel arm, on the other side of the first or second bearing member a first guiding means which is facing towards the adjacent carrier unit, in particular a protrusion, or which is an extension of the swivel arm. In addition with this embodiment there is provided in or on said adjacent part of the carrier unit an, in particular arc-shaped, second guiding means, in particular a guiding groove or guiding rail. Said first guiding means is arranged and adapted that it engages with said second guiding means. By use of corresponding first and second guiding means even very heavy, i.e. large adhesive tape rolls can be operated without any problems. Moreover, by use of said guiding means the swivel arm does not wear out or is not impaired even when the adhesive tape dispenser is permanently in use.

Moreover, with the circumferential extension of said second guiding means the extent of pivoting of the swivel arm can be accurately determined thereby omitting any unnecessary clearance. In such a manner care can even be taken as to the maximum size of adhesive tape rolls to be used with a specific tape dispenser.

Those adhesive tape dispensers have been found to be advantageous which further comprise a support member, in particular having a cylindrical shape, which is connected to the carrier unit and which in particular is rotatable about its axis. Said support member can for example be a fixed support arm, and may also act as a limit stopper. Said fixed support member, e.g. limit stopper, is arranged and adjusted to support the adhesive tape roll by pressing against said support member via the swivel arm being impacted by said spring element, i.e. by spring force. By use of said support member, e.g. in the form of a fixed arm, not only the housing but also the tape being guided from the adhesive tape roll to the dispensing unit can be protected. It furthermore allows for smoothly unwinding adhesive tape from the tape roll irrespective of the (remaining) size of said roll. Moreover, by use of said support member, in particular a fixed support arm, any noise generated in connection with unwinding and applying adhesive tape to an object can be significantly reduced.

Preferred embodiments of the adhesive tape dispenser according to the present disclosure have been found to be most suitable which further comprise an, in particular plate-shaped or rod-shaped, release device for the cutting blade (152 in FIGS. 1, 3, 4, 8*b*, and 9). While the cutting blade in one embodiment may be permanently available for cutting adhesive tapes it has been found to be beneficial to release the cutting blade only in those cases the adhesive tape shall be severed. This is accomplished by use the release device. In case said release device is activated, e.g. pushed or pressed against the object onto which the adhesive tape is applied, the cutting blade is extended or moved out of its retracted position. Accordingly, the release device can for example be activated by just slightly tilting the adhesive tape dispenser in particular when the release device has a plate-like or rod-like shape.

Another preferred embodiment of the adhesive tape dispenser according to the present disclosure further comprises at least one guide element, in particular guide lug, adapted and arranged in such a manner that adhesive tape is guided between said at least one guide element and the support member, in particular the fixed arm, towards the applicator unit. By use of said guide element premature adhesion of an adhesive tape to an object can be prevented.

According to another preferred embodiment the grip member of the adhesive tape dispenser of the present disclosure comprises a recess, in particular a recess for a thumb, at one of its endings and/or at the transition to the connecting member. In this manner a very safe handling of the adhesive tape dispenser can be accomplished.

The grip member preferably has a longitudinal orientation. Moreover, said longitudinal orientation is advantageously aligned essentially in parallel to and spaced apart from a tangent applied to the outer contour of an adhesive tape roll supportable or supported on said receiving member or on said first bearing shaft. Different from prior art adhesive tape dispensers, with the present disclosure the grip member or the longitudinal orientation of the grip member is preferably not aligned radially in relation to the bearing shaft of the first or second bearing member and/or is not aligned radially in relation to an adhesive tape roll supportable or supported on said receiving member or on said first bearing shaft.

It is also preferred that the grip member comprises at least one recess, in particular a multitude of recesses, in particular in the form of holes, on its surface. By use of said recesses the hand by which the grip is used can experience some ventilation during use. In addition, the amount of sweating in the palm of a hand can be reduced. This allows to reduce accidents on the job and also a more reliable operation during the packaging process.

It is also possible to make use of a grip member which is hollow at least in sections. Such grip member contributes to reducing the weight of the adhesive tape dispenser of the disclosure even further.

The adhesive tape dispenser of the present disclosure can be provided with any conventional adhesive tape roll or preferably with an adhesive tape roll according to the present disclosure as outlined below. Suitable adhesive tape rolls have a core element, which is rotatably mounted on the bearing shaft of the first bearing member or on the receiving member, wherein the adhesive tape is wound onto the core element.

It is most preferred to make use of a core element which comprises a receiving opening extending through the core element in the longitudinal direction which receiving opening has a polygonal cross-section. Those adhesive tape dispenser allow for a very *facile* and accurate operation in which the receiving opening of the core element comprises at least one stop at or adjacent to an end of the receiving opening.

In order to allow for a reliable release of the adhesive tape roll the first bearing shaft or the receiving member should comprise at least one engaging element for engaging interaction with the core element of the adhesive tape roll. Moreover, the core element should also comprise at least one release mechanism for releasing the engaging interaction in order to allow removal of the adhesive tape roll.

Accordingly, in a very pragmatic embodiment the first bearing shaft or the receiving member comprises at least one, in particular spring loaded, engaging element for engaging interaction with the core element of the adhesive tape roll. Moreover, it has been found to be particularly advantageous that said first or second bearing member comprises at least one release mechanism for disengaging the engaging interaction, e.g. by pressing the release mechanism button, in order to allow removal of the adhesive tape roll.

Those adhesive tape dispenser according to the present disclosure have been found to be of advantage, in particular in terms of ergonomics in which the center of gravity of the adhesive tape dispenser is located at or adjacent to the first bearing member, the second bearing member or the receiving member.

Accordingly, the adhesive tape dispenser of the present disclosure is preferably equipped with a core element which comprises a receiving opening extending through the core element in the longitudinal direction from a first end to an opposed second end and having a polygonal cross-section which cross-section essentially corresponds in form and shape with the polygonal cross-section of the bearing shaft of the first bearing member or with that of the receiving member so that said first bearing shaft or said receiving member is insertable, essentially in a perfectly fitting manner, into the receiving opening.

The walls forming the receiving opening preferably comprise sections having a circular shape, wherein these circular-shaped sections are disposed on the circumference of a circle the center of which essentially corresponds to the center of the adhesive tape roll.

By use of a core element which beyond the receiving opening and the walls forming the receiving opening comprises a multitude of ribs the weight of an adhesive tape dispenser according to the disclosure can be significantly reduced without sacrificing on the side of mechanic stability.

In another embodiment those sections of the walls forming the receiving opening which have a circular-shaped cross-section can also comprise a bulge, in particular centrally located within said section having a circular-shaped cross-section. Said bulge interrupts the circular-shaped cross-section and projects into the receiving opening. Said bulge preferably has a semi-circular cross-section. It preferably does not extend into the receiving opening such that it may interfere with the polygonal cross-section.

According to another aspect of the present disclosure an adhesive tape roll is provided consisting of or comprising a core which comprises a receiving opening extending through the core in the longitudinal direction and an adhesive tape which is wound onto the core, wherein the core consists of or comprises a plastic material or a metal material, preferably a plastic material, that the receiving opening which extends through the core has a polygonal cross-section, and that at least one stop is provided at an end of the receiving opening. By use of polygonal cross-section not only the life-time of the product can be prolonged, it also is possible to apply force more accurately onto the adhesive tape roll.

The adhesive tape roll of this aspect of the present disclosure is preferably provided with a core which consists of or comprises, on the one hand, an outer sleeve that receives the adhesive tape on its outer side and, on the other hand, an inner sleeve extending at a spacing from, and coaxially with the outer sleeve and which comprises the receiving opening, and wherein furthermore multiple connection bridges are distributed around the circumference of the inner hole of the outer sleeve and of the outer side of the inner sleeve, respectively, between the outer sleeve and the inner sleeve.

According to another advantageous embodiment of the adhesive tape roll of this aspect of the present disclosure the core is formed integrally from the outer sleeve, inner sleeve and connection bridges.

According to another advantageous embodiment of the adhesive tape roll of this aspect of the present disclosure molded-in elements having the shape of segments of a circle, which jointly form the cylindrical receiving opening, are provided in the walls of the inner sleeve that are formed by the polygonal cross-section of the receiving opening.

According to another advantageous embodiment of the adhesive tape roll of this aspect of the present disclosure an inner circumferential groove is molded in on the inner side of the inner sleeve or molded into the receiving opening.

According to another aspect of the present disclosure a device for unwinding an adhesive tape roll is provided, essentially consisting of or comprising at least a grip element for handling the device, a bearing element for receiving the core of the adhesive tape roll and rotatably supporting said roll, and a dispensing element for attaching the adhesive tape to objects, wherein the bearing element consists of a bearing shaft which is fixedly arranged on the device and on which a receiving element for the adhesive tape roll is rotatably supported, wherein the outer contour of the receiving element has a polygonal cross-section.

With said device for unwinding an adhesive tape roll it is preferred that at least one latching element is radially movably guided in the receiving element, which latching element engages in an inner circumferential groove in a receiving opening of the core of the adhesive tape roll after the adhesive tape roll has been mounted. Here, the latching element advantageously is a ball or said latching elements are balls. Those devices are also preferred in which the latching element(s) is/are held in a locked position by a spring load.

According to another advantageous embodiment of the device for unwinding an adhesive tape roll the latching element(s) is/are switched from its/their locked position into an unlocked position by operating an unlocking element for removing the adhesive tape roll from the receiving element.

According to another advantageous embodiment of the device for unwinding an adhesive tape roll the unlocking element is guided and can move in axial direction between the bearing shaft and the receiving element. And, the latching element(s) protrude(s) from the outer circumference of the receiving element in the locked position, and the latching element(s) is/are moved into, and held in, a recess in the unlocking element after the unlocking element is axially moved into the unlocked position. Said recess in the unlocking element is preferably formed by an outer circumferential groove molded in on its outer circumference. Moreover, in a pragmatic embodiment the unlocking element is held in the locked position under a spring load.

In the following description, the patented disclosure is explained in more detail by means of preferred embodiments of an adhesive tape dispenser wherein FIG. 1 is a schematic perspective front side view of a first embodiment of an adhesive tape dispenser of the present disclosure;

Figure 5:
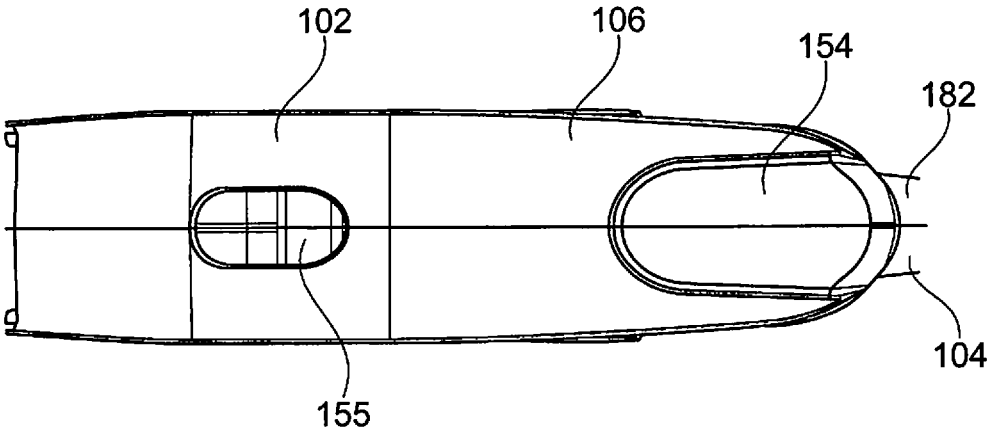
Figure 6:
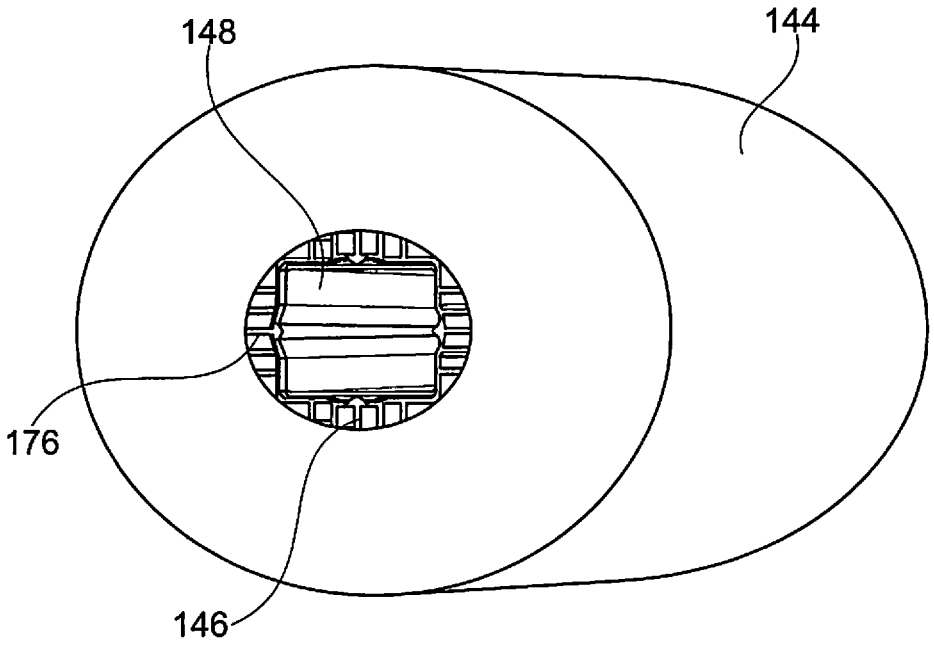
Figure 7:
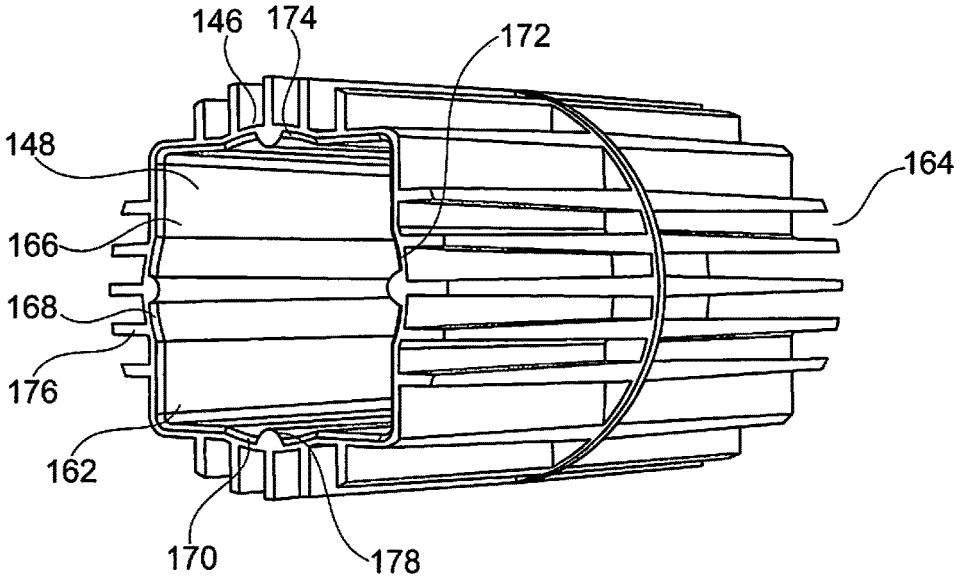
Figure 8A:
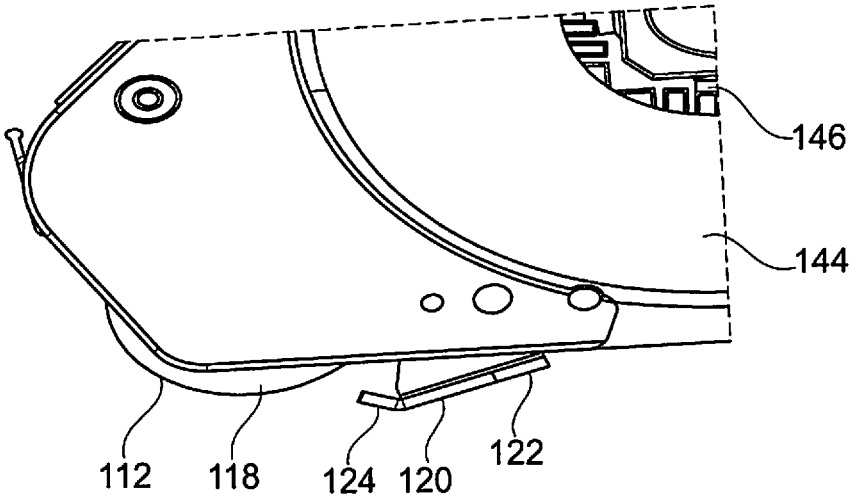
Figure 8B:
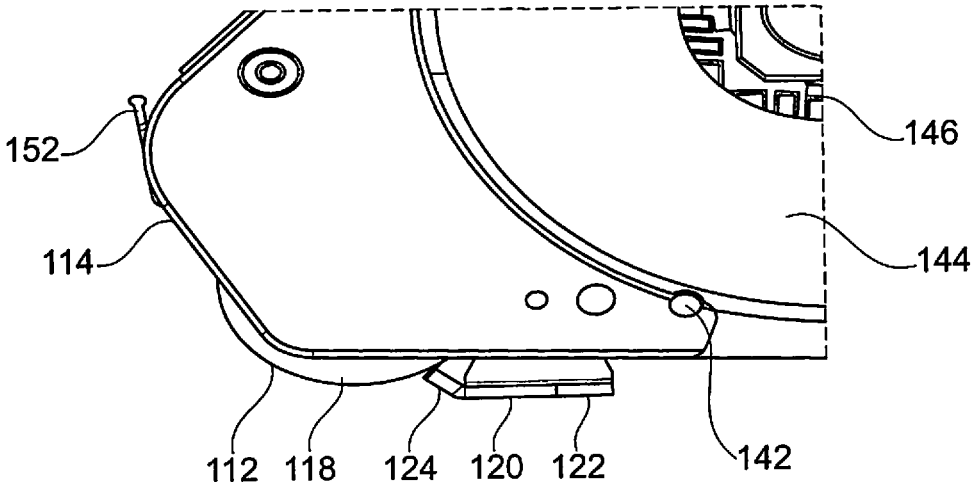
Figure 9:
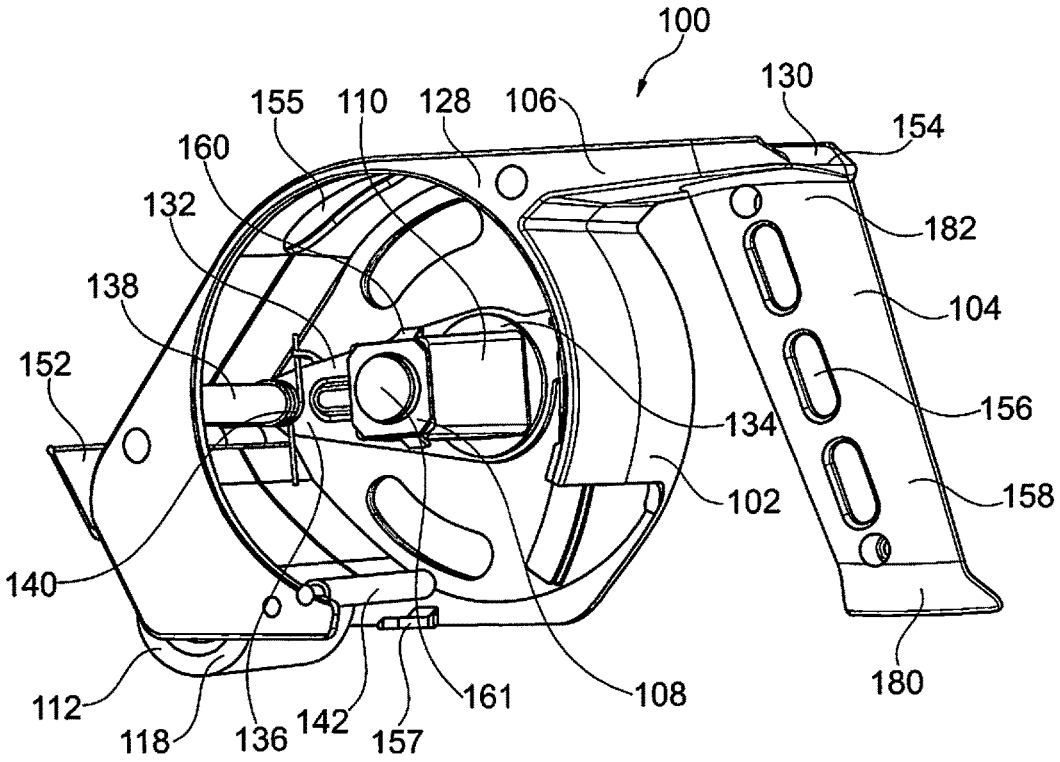
Figure 10:
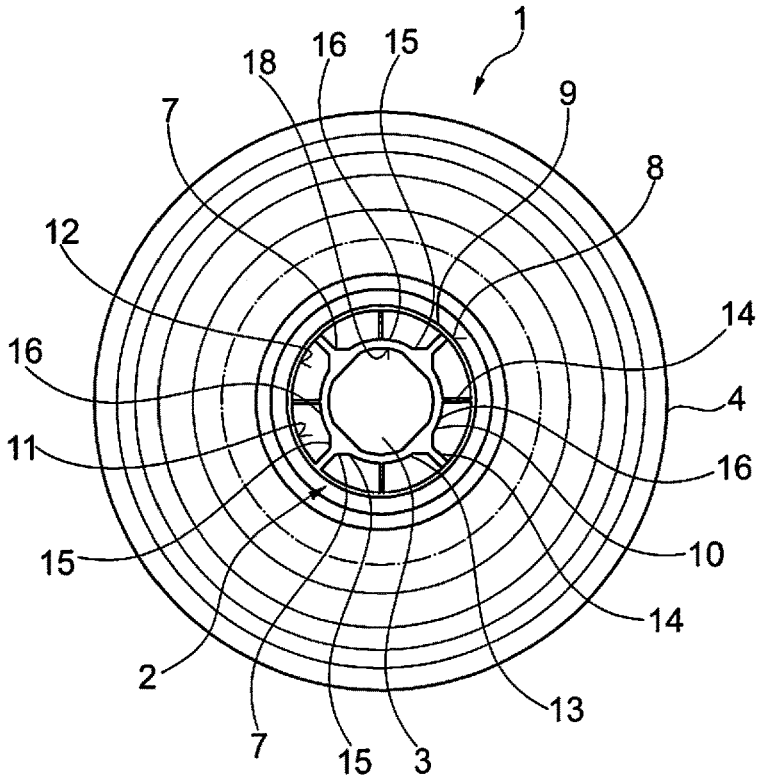
Figure 11:
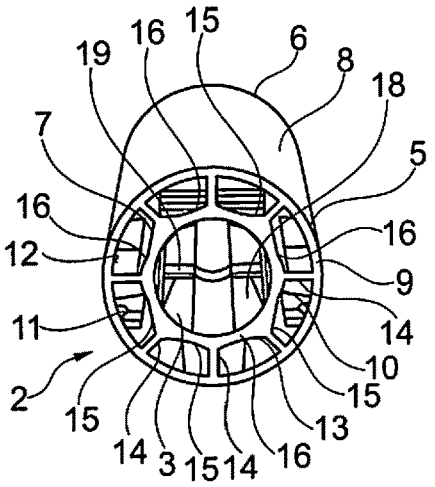
Figure 12:
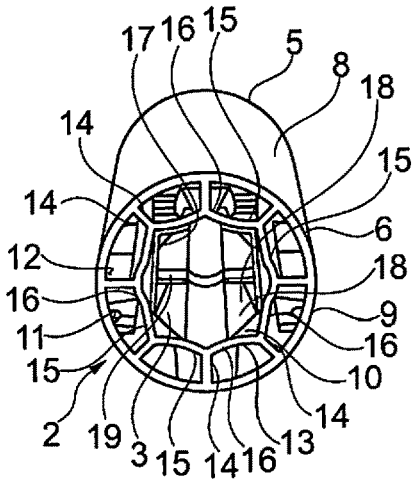
Figure 13:
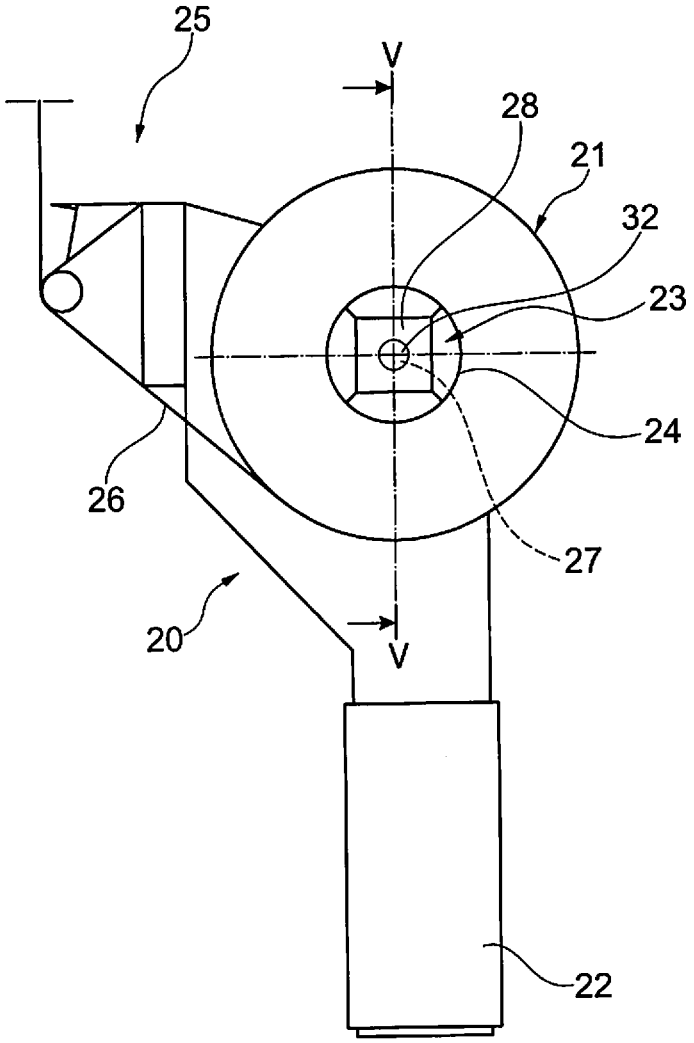
Figure 14:
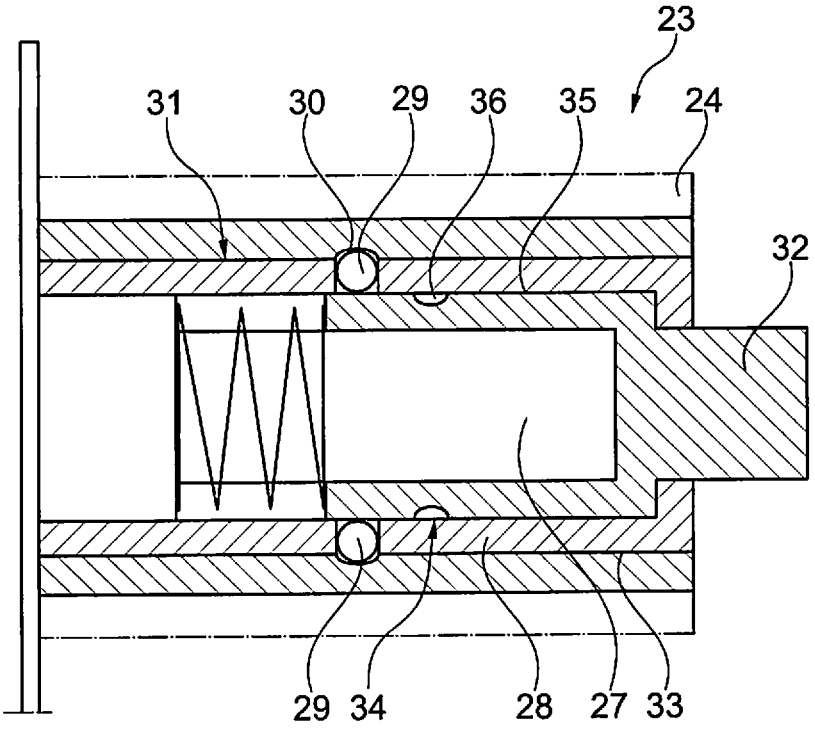

FIG. 5 a schematic top side view of a part of an adhesive tape dispenser according to the disclosure;

FIG. 6 is a schematic perspective front side view of an adhesive tape roll containing a core element;

FIG. 7 is a schematic perspective view of the core element of the adhesive tape roll according to FIG. 6;

FIGS. 8*a, b* show two states of a component of the adhesive tape dispenser according to the present disclosure;

FIG. 9 shows another embodiment of the adhesive tape dispenser of the present disclosure;

FIG. 10 shows a schematic side view of an adhesive tape roll;

FIG. 11 shows a schematic perspective view of an adhesive tape roll according to the present disclosure from its first side;

FIG. 12 shows a schematic perspective view of the adhesive tape roll according to FIG. 11 from the opposite second side;

FIG. 13 shows a schematic side view of another adhesive tape dispenser according to the present disclosure; and FIG. 14 shows a section along the V-V line in FIG. 13.

Figure 1:
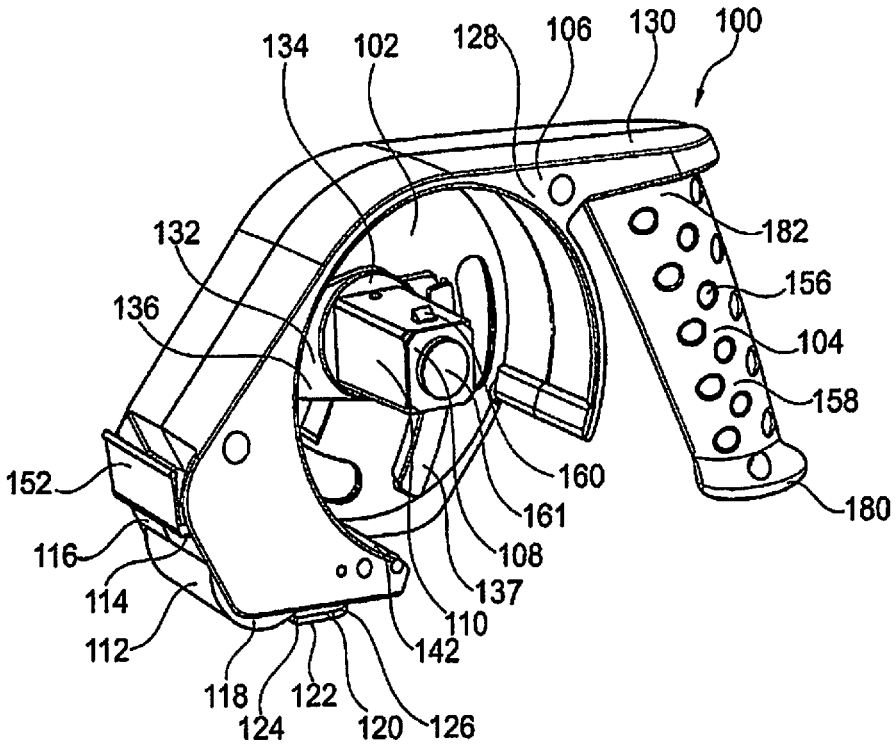

In FIG. 1 an adhesive tape dispenser 100 is depicted without an adhesive tape roll being present. Said adhesive tape dispenser 100 comprises a carrier unit 102 which with the embodiment of FIG. 1 also forms a housing for an adhesive tape roll. The adhesive tape dispenser 100 is provided with a grip member 104 which allows easy handling of the adhesive tape dispenser during operation. The grip member 104 has a first end 180 and an opposite second end 182. Through the center of the grip member 104 a longitudinal axis can be drawn between the first end 180 and the second end 182 (not depicted). Such longitudinal axis usually corresponds to the longitudinal orientation of grip member 104 between the first 180 and the second 182. It is essential for the adhesive tape dispenser of the present disclosure that the grip member 104 is located opposite to the tape dispensing unit 112 with respect to the first bearing member 108 which comprises a rotatable bearing shaft 110. The grip member 104 is connected to the carrier unit 102, that is to the housing by way of connecting member 106 in the embodiment shown in FIG. 1. In another embodiment (not depicted) it is also possible to make use of a grip member which at its second end 182 is bent towards the carrier unit/housing 102. Still also with such an embodiment a grip member 104 is provided which is spaced apart from carrier unit/housing 102 so that during manual operation fingers can be placed between the grip member 104 and the housing 102. In another embodiment it may also be possible to connect the grip member 104 to the carrier unit/housing 102, additionally or alternatively, by way of a connecting member 106 which is connected to the first or second end 180, 182 or to the middle section of the grip member 104 on the one hand and to the carrier unit/housing 102 on the other hand. With all these embodiments the grip member 104 is still spaced apart from the carrier unit/housing 102. Different from conventional prior art adhesive tape dispenser the grip member 104 of the adhesive tape dispenser of the present disclosure as depicted in FIG. 1 is not arranged radially with respect to the first bearing member 108 or to an adhesive tape roll being placed on said bearing member. With respect to said bearing member 108 the grip member 104 is positioned opposite to the dispensing unit 112. Said dispensing unit 112 in the embodiment depicted in FIG. 1 comprises a rotatably mounted roll 118. By pressing said roll 118 against an object and moving the adhesive tape dispenser 100 downwards adhesive tape is wound from the adhesive tape roll. Said adhesive tape roll can be releasably fixed on the first bearing member 108 depicted in FIG. 1 by use of engaging element 160. Said engaging element 160 can be released by a release mechanism for disengaging the engaging interaction by pressing the release mechanism button 161 in order to allow removal of the adhesive tape roll.

In the embodiment depicted in FIG. 1 the first bearing member 108 is not directly connected to the carrier unit/housing 102 but is rotatably mounted to a swivel arm 132. Said swivel arm 132 has a first end 134 and an opposite second end 136. While the rotatably mounted bearing member 108 is located at the first end 134 said second end 136 is rotatably fastened to the carrier unit/housing 102 by way of a connecting means 138 (not shown). To alleviate in particular longer handling periods recesses or holes 156 are provided in the grip surface 158.

Figure 2:
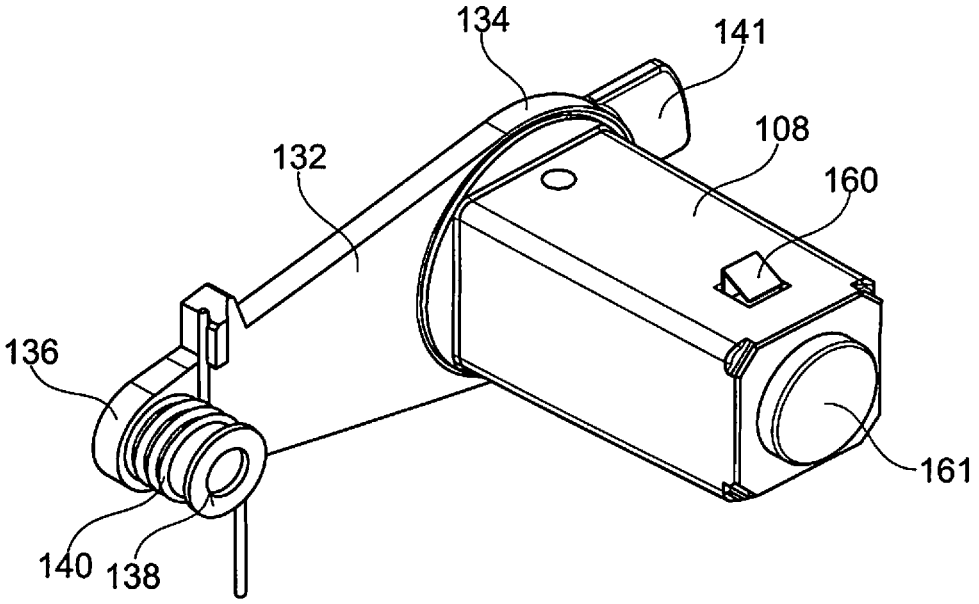
FIG. 2 is a schematic perspective view of a component of the adhesive tape dispenser according to FIG. 1.

Details of the swivel arm 132 can also be derived from FIG. 2. The rotatable first bearing member 108 is located at the first end 134 of said swivel arm 132. As an extension to said first end 134 there is provided a first guiding means 141 which is located beyond the first bearing member 108 with respect to the second end 136 of the swivel arm 132. At the second end 136 a rotatable connecting means 138 is provided in order to connect the swivel arm 132 to the carrier unit 102 so that said swivel arm can be pivotally moved about said connecting means 138. At the second end 136 of the swivel arm 132 an elastic element in the form of a spring 140 is provided which exerts spring load onto the swivel arm 132. In this manner said swivel arm is pressed into the direction of the support member, e.g. fixed support arm 142. When an adhesive tape roll is placed on the bearing member 108 the outer contour of the adhesive tape roll is pressed against the support member 142 due to the spring load provided by the elastic element 140. In order to allow for proper operation the support member 142 preferably has a cylindrical shape and is rotatable about its axis. In this manner the rotation of the adhesive tape roll is not hampered by any frictional forces. Moreover, said support member greatly reduces any noise usually generated in connection with the unwinding process. It has been found to be beneficial to guide the first guiding means 141 in a second guiding means 137, which with the embodiment depicted in FIG. 1 has the form of a guiding rail.

The embodiment of an adhesive tape dispenser 100 as shown in FIG. 1 also comprises a so-called spacer 120. Said spacer 120 may serve various purposes and can either be invariably fixed to the carrier unit 102 or can be movably fastened, in particular rotatably attached to the carrier unit 102. Said spacer 120 on the one hand can protect the adhesive tape which is unwound from the adhesive tape roll and guided towards and over the dispensing unit 112. On the other hand said spacer 120 is limiting the operational region of the dispensing unit 112, in particular of the rotatably mounted roll 118 which can be used for applying the adhesive tape to an object, thereby guiding the person skilled in the art towards a most beneficial operation of the adhesive tape dispenser. Moreover when pivotably or rotatably mounted the spacer 120 is moved towards the dispensing unit 112 during operation. In this manner, as can for example be derived from FIGS. 8*a*) and *b*) the first end 124 of the spacer 120 is pushed against the dispensing roll 118, that is against the adhesive tape placed on said roll 118. In this manner any noise generated in connection with unwinding and applying adhesive tape to an object can be significantly reduced.

Figure 3:
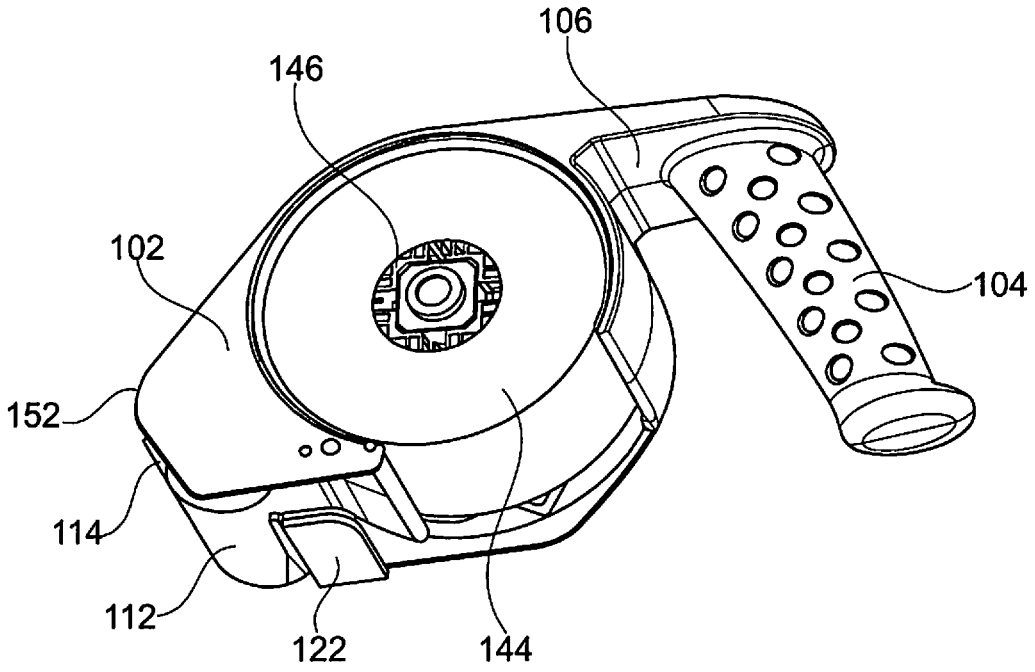
FIG. 3 is a schematic perspective front side view of an adhesive tape dispenser according to the disclosure equipped with an adhesive tape roll.

Details of how to operate the adhesive tape dispenser 100 of the present disclosure can also be visualized based on FIG. 3 which depicts an adhesive tape dispenser 100 being equipped with an adhesive tape role 144. By holding the grip member 104 and pulling the adhesive tape dispenser 100 downwards an adhesive tape can be unwound from the adhesive role 144 in that it is transferred via the dispensing unit 112 to an object. Due to the fact that the grip member 104 is spaced apart from the carrier unit 102 and in particular from the dispensing unit 112 where the adhesive tape is applied to an object said adhesive tape dispenser can be operated with as little effort as possible. Thereby, the application of adhesive tape by use of the adhesive tape dispenser 100 of the present disclosure is less tiring than with conventional adhesive tape dispensers.

Figure 4:
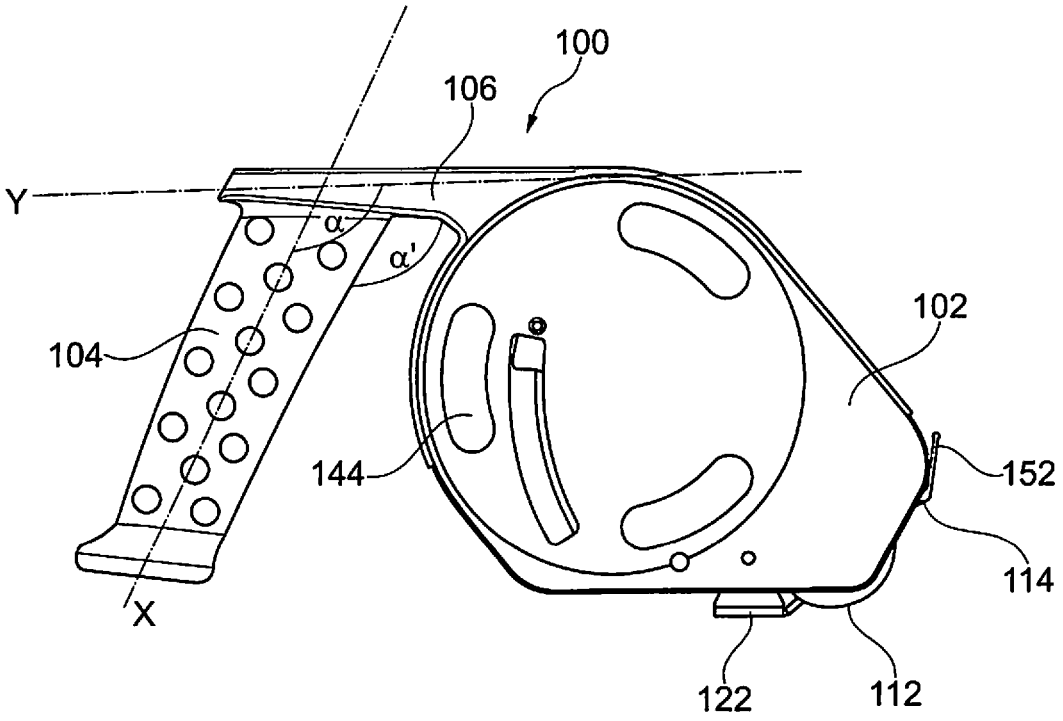
FIG. 4 is a plan view of the backside of the adhesive tape dispenser according to FIG. 1.

In FIG. 4 the back side of the adhesive tape dispenser 100 of FIG. 1 is depicted. This presentation highlights in particular the connecting member 106 which allows to arrange the grip member 104 spaced apart from the carrier unit/housing 102 of the adhesive tape dispenser 100. It can also be derived from FIG. 4 that the connecting member 106 may function as a lever. The angle $\alpha$ between the grip member 104 and the connecting member 106, that is between the longitudinal orientation or longitudinal axis X of the grip member 104 and the longitudinal orientation or longitudinal axis Y of the connecting member 106 preferably is an obtuse angle. Usually, said angle $\alpha$ between the respective longitudinal axes of the grip member 104 and the connecting member 106 and the angle $\alpha'$ between the outer contour of the grip member 104 and the connecting member 106 essentially correspond to each other or deviate only slightly from each other. From FIG. 4 it is also evident that the longitudinal axis X of the grip member 104 is spaced apart from and parallel to a tangent applied to the outer contour of the adhesive tape role 144 placed on the bearing member (not shown).

In FIG. 5 a section of the adhesive tape dispenser 100 is shown when viewed from above, that is when looking from above on the connecting member 106. In the preferred embodiment depicted in FIG. 5 a recess 154 is provided in that part of the connecting member 106 which forms a transition from the second end 182, that is the upper part of the grip member 104 to the connecting member 106. While the grip member 104 can be held by all four fingers the thump can be placed in recess 154 thereby guaranteeing a more safe and reliable handling of the adhesive tape dispenser 100 of the present disclosure. Moreover, the housing 102 of the dispenser 100 as depicted in FIG. 5 has a hole 155 on its top side through which access to the adhesive tape roll is provided. Via hole 155 the tape roll can be pushed thereby activating the swivel arm.

In FIG. 6 an adhesive tape role 144 is depicted having a core element 146 which is provided with a receiving opening 148 having a polygonal cross-section. In order to reduce the weight of the adhesive tape roll the core element 146 preferably is made of plastic material. Moreover, a multitude of ribs 176 is used to guarantee mechanical strength. Details of the core element 146 can be derived from FIG. 7. The receiving opening 148 extends through the core element 146 in longitudinal direction from a first end 162 to an opposed second end 164. The walls forming the receiving opening have a polygonal cross-section. In a preferred embodiment the walls 166 forming the receiving opening 148 comprise sections 168, 170, 172 and 174 having a circular shape. These circular-shaped sections are disposed on the circumference of a circle the center of which essentially corresponds to the center of adhesive tape roll being wound onto the core element 146. These circular-shaped sections enable the use of a cylindrical shaft having a circular cross-section for winding adhesive tape onto the core element 146. In order to obtain a sufficient fit between said shaft and the receiving opening of the core element 146 those sections 168, 170, 172 and 174 having a circular-shaped cross-section can be provided with a bulge which preferably runs along the entire longitudinal length of the core element and which in particular is centrally located within said section having a circular shaped cross-section. Said bulge 178 interrupts the circular-shaped cross-section and projects towards the receiving opening. And, said bulge 178 preferably has a semi-circular cross-section. Most preferably said bulge 178 extends into the receiving opening, however, only to an extent so that it does not interfere with the polygonal cross-section.

Another preferred embodiment of an adhesive tape dispenser 100 of the present disclosure is depicted in FIG. 9. This adhesive tape dispenser is essentially identical to the dispenser shown in FIG. 1, however, it does not contain the spacer device 120 but instead is equipped with a pair of oppositely positioned guide lugs 157 which are located on the carrier unit/housing 102 in the vicinity of the support member 142. These guide lugs 157 are moreover positioned between the support member 142 and the applicator unit 112 and aid in preventing the adhesive tape from being prematurely attached to objects.

FIG. 10 shows a side view of an adhesive tape roll 1 which, as is generally known from prior art, consists of a core 2 which comprises a receiving opening 3 extending through the core 2 in the longitudinal direction and an adhesive tape 4 which is wound onto the core 2. The adhesive tape roll 1 can be inserted, for example, in a handheld device for unwinding adhesive tape rolls as shown, for example, in FIG. 13, for easy and fast unwinding and cutting of the adhesive tape 4.

The core 2 preferably consists of a plastic. As shown in FIGS. 11 and 12 which show a perspective view of the two ends 5, 6 of the core 2, the receiving opening 3 that extends through the core 2 can be configured with a polygonal cross-section (shown with a square cross-section in FIGS. 10-12, for example) for a positive-locking connection with the device mentioned above. At least one stop 7 that prevents incorrect insertion of the adhesive tape roll 1 into the device mentioned above may be provided at one end 5 of the core 2 or receiving opening 3.

The core 2 may consist, on the one hand, of an outer sleeve 9 that receives the adhesive tape 4 on its outer side 8 and, on the other hand, of an inner sleeve 10 extending at a spacing from, and coaxially with, the outer sleeve 9 and comprising the receiving opening 3. Multiple connection bridges 14 may be distributed on the circumference 11 of the inner hole 12 of the outer sleeve 9 and on the outer side 13 of the inner sleeve 10, respectively, between the outer sleeve 9 and the inner sleeve 10. The core 2 may be formed integrally from the outer sleeve 9, inner sleeve 10, and connection bridges 14.

Molded-in elements 16 having the shape of segments of a circle when seen in cross-section, which jointly form a cylindrical receiving hole 17, may be provided in the walls 15 of the inner sleeve 10 that are formed by the polygonal cross-section of the receiving opening 3. This ensures the use of the adhesive tape roll 1 in devices for unwinding adhesive tape rolls which comprise a cylindrical receiving element.

An inner circumferential groove 19 in which at least one latching element can engage may be molded in on the inner side 18 of the inner sleeve 10 or molded into the receiving opening 3.

FIG. 12 shows an exemplary and simplified side view of a simple device 20 for unwinding an adhesive tape roll 21. The device 20 essentially consists at least of a grip element 22 for handling the device 20, a bearing element 23 for receiving the core 24 of the adhesive tape roll 21 and rotatably supporting said roll, and a dispensing element 25 for attaching the adhesive tape 26 to objects, The bearing element 23 may consist of a bearing shaft 27 which is fixedly arranged on the device 20 and on which a receiving element 28 for the adhesive tape roll 21 may be rotatably supported. The outer contour of the receiving element 28 may have a polygonal cross-section, which enables a positive-locking connection with the adhesive tape roll 21.

As shown in a simplified manner in the embodiment according to FIG. 14, which shows a section along the V-V line in FIG. 13, at least one latching element 29 may be radially movably guided in the receiving element 28, which latching element may engage in an inner circumferential groove 30 in a receiving opening 31 of the core 24 of the adhesive tape roll 21 after the adhesive tape roll 21 has been mounted. The latching element 29 can be a ball or the latching elements 29 can be balls and prevent axial movement of the adhesive tape roll 21 on the receiving element 28.

The latching element(s) 29 may be held in the locked position by a spring load (not shown).

For removing the adhesive tape roll 21 from the receiving element 28, the latching element(s) 29 is/are switched from its/their locked position into an unlocked position by operating an unlocking element 32.

The unlocking element 32 can be guided and can move in the axial direction in the receiving element 28 between the bearing shaft 27 and the receiving element 28, wherein the latching element(s) 29 protrude(s) from the outer circumference 33 of the receiving element 28 in the locked position. After axially moving the unlocking element 32 into the unlocked position, the latching element(s) 29 can enter a recess 34 in the unlocking element 32 and be held in said recess.

The recess 34 in the unlocking element 32 may be formed by an outer circumferential groove 36 molded in on its outer circumference 35. The unlocking element 32 may be held in the locked position under a spring load.

The device 20 may also be used for unwinding the adhesive tape roll 1.

Although modifications and changes may be suggested by those skilled in the art, it is the intention of the applicant to embody within the patent warranted hereon all changes and modifications as reasonably and probably come within the scope of this contribution to the art. The features of the present disclosure which are believed to be novel are set forth in detail in the appended claims. The features disclosed in the description, the figures as well as the claims could be essential alone or in every combination for the realization of the disclosure in its different embodiments.

Priority patent filing document DE 10 2014 209 834.3 filed May 23, 2014 is hereby incorporated by reference in its entirety for all purposes.

The invention claimed is:

1. Adhesive tape dispenser, for an adhesive tape roll having a core element, the dispenser comprising:

a carrier unit, at least one grip member being connected to the carrier unit for handling of the adhesive tape dispenser, wherein the grip member is a handle portion which is held by a user during regular operation and has a longitudinal orientation, a first bearing member comprising a first rotatable bearing shaft arranged and adjusted for receiving the core element of the adhesive tape roll and for rotatably supporting said roll which is directly or indirectly arranged on and/or fastened to the carrier unit, or a second bearing member comprising a second bearing shaft, which is directly or indirectly arranged on and/or fastened to the carrier unit, and a receiving member arranged and adjusted for receiving the core element of the adhesive tape roll that is rotatably arrangeable or supported on said second bearing shaft, an applicator unit for attaching the adhesive tape to objects which is directly or indirectly joined to the carrier unit or which is integral with said carrier unit, at least one fastening means for a cutting blade, which is directly or indirectly joined to the carrier unit or which is integral with said carrier unit, characterized in that the grip member and applicator unit are located on opposite sides of the first or second bearing member and/or of the center of gravity of the dispenser, wherein the adhesive tape dispenser comprises a plate-shaped or rod-shaped release device for the cutting blade, wherein when the release device is pushed or pressed against the object onto which the adhesive tape is applied by tilting the adhesive tape dispenser, the cutting blade is extended out of a retracted position, wherein a connecting member comprises a first and an opposite second end and a longitudinal orientation between said first and second end, that said first end is joined or combinable with or integral with the carrier unit and that said second end is joined or combinable with or integral with the grip member, and that the longitudinal orientation of the connecting member and the longitudinal orientation of the grip member at its second end of said connecting member and facing towards the carrier unit form an obtuse angle, wherein the adhesive tape dispenser further comprises a swivel arm pivotably mounted about a rotational axis to the carrier unit comprising a first end and an opposite second end comprising at or adjacent to said first end said first bearing member, or said first rotatably mounted bearing shaft, or said second bearing member, or said receiving member, and adjacent to said second end a pivotable connecting means with the carrier unit, and further comprising an elastic element or a spring element adapted and arranged in a manner that it exerts a spring load onto the swivel arm.

2. The adhesive tape dispenser according to claim 1, characterized in that a longitudinal orientation of the grip member is aligned essentially in parallel to a tangent which is alignable to the outer contour of an adhesive tape roll supportable or supported on said receiving member or on said first bearing shaft and/or the longitudinal orientation of the connecting member is aligned essentially in parallel and optionally spaced apart from a tangent which is alignable to the outer contour of an adhesive tape roll supportable or supported on said receiving member or on said first bearing shaft.

3. The adhesive tape dispenser according to claim 1, characterized in that at or adjacent to the first end of the swivel arm there is provided a first guiding means and a second guiding means and wherein said first guiding means engages with said second guiding means.

4. The adhesive tape dispenser according to claim 3, characterized in that the first guiding means is an extension of the swivel arm.

5. The adhesive tape dispenser according to claim 1, further comprising a support member, which is connected to or an integral part of the carrier unit arranged and adjusted to support the adhesive tape roll being pressed against said support member via the swivel arm being impacted by said elastic element or said spring element.

6. The adhesive tape dispenser according to claim 5, further comprising at least one guide element adapted and arranged in such a manner that adhesive tape is guided between said at least one guide element and the support member towards the applicator unit.

7. The adhesive tape dispenser according to claim 1, characterized in that the grip member at an end thereof and/or at a transition to the connecting member comprises a recess.

8. The adhesive tape dispenser according to claim 1, characterized in that the grip member has a longitudinal orientation and that said longitudinal orientation is aligned essentially in parallel to and spaced apart from a tangent applied to the outer contour of an adhesive tape roll supportable or supported on said receiving member or on said first bearing shaft.

9. The adhesive tape dispenser according to claim 1, further comprising an adhesive tape roll, having a core element, which is rotatably mounted on the bearing shaft of the first bearing member or on the receiving member, wherein the adhesive tape is wound onto the core element.

10. The adhesive tape dispenser according to claim 9, comprising an adhesive tape roll, comprising a core which comprises a receiving opening extending through the core in the longitudinal direction and an adhesive tape which is wound onto the core, characterized in that the core comprises a plastic material or a metal material, that the receiving opening which extends through the core has a polygonal cross-section, and that at least one stop is provided at an end of the receiving opening.

11. The adhesive tape dispenser according to claim 10, characterized in that at least one stop is provided at or adjacent to an end of the receiving opening.

12. The adhesive tape dispenser according to claim 9, characterized in that the core element comprises a receiving opening extending through the core element in the longitudinal direction wherein the receiving opening has a polygonal cross-section and which cross-section essentially corresponds in form and shape with a polygonal cross-section of the bearing shaft or with the receiving member so that said first bearing shaft or said receiving member is insertable into the receiving opening.

13. The adhesive tape dispenser according to claim 1, characterized in that the first bearing shaft or the receiving member comprises at least one engaging element for engaging interaction with the core element of the adhesive tape roll and/or that said first or second bearing member comprises at least one release mechanism for disengaging the engaging interaction in order to allow removal of the adhesive tape roll.

14. The adhesive tape dispenser according to claim 13, characterized in that the engaging element is spring loaded.

15. The adhesive tape dispenser according to claim 1, characterized in that the center of gravity of the adhesive tape dispenser is located at or adjacent to the first bearing member or the first bearing shaft, or the second bearing member or the receiving member.

16. The adhesive tape dispenser according to claim 1, characterized in that the carrier unit is a housing.

17. The adhesive tape dispenser according to claim 1, characterized in that the second bearing shaft is non-rotatable.

18. The adhesive tape dispenser according to claim 1, characterized in that the applicator unit is rotatable.

19. The adhesive tape dispenser according to claim 1, further comprising a cutting blade held by said fastening means.

20. The adhesive tape dispenser according to claim 1, characterized in that the swivel arm and/or the pivotable connecting means comprises or is made of metal.

21. The adhesive tape dispenser according to claim 1, characterized in that the elastic element or the spring element is located at the connecting means.

* * * * *